US009048635B2

(12) United States Patent
Quitmeyer

(10) Patent No.: US 9,048,635 B2
(45) Date of Patent: Jun. 2, 2015

(54) SPARK PLUG WITH LASER KEYHOLE WELD ATTACHING GROUND ELECTRODE TO SHELL

(71) Applicant: FEDERAL-MOGUL IGNITION COMPANY, Southfield, MI (US)

(72) Inventor: Frederick J. Quitmeyer, Rochester Hills, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 14/204,281

(22) Filed: Mar. 11, 2014

(65) Prior Publication Data

US 2014/0265814 A1 Sep. 18, 2014

Related U.S. Application Data

(60) Provisional application No. 61/780,096, filed on Mar. 13, 2013.

(51) Int. Cl.

| | |
|---|---|
| ***H01T 13/20*** | (2006.01) |
| ***H01T 13/32*** | (2006.01) |
| ***H01T 21/02*** | (2006.01) |

(52) U.S. Cl.

CPC ..... *H01T 13/32* (2013.01); *H01T 21/02* (2013.01)

(58) Field of Classification Search

CPC ..... H01T 13/32; H01T 21/02; H01T 13/20

USPC ..... 313/141, 144

See application file for complete search history.

(56) References Cited

U.S. PATENT DOCUMENTS

| | | | | |
|---|---|---|---|---|
| 6,307,307 | B1 | 10/2001 | Kanao | |
| 6,326,719 | B1 | 12/2001 | Boehler et al. | |
| 6,373,172 | B1 | 4/2002 | Kanao et al. | |
| 6,406,345 | B2 | 6/2002 | Boehler et al. | |
| 7,011,560 | B2 | 3/2006 | Downs et al. | |
| 7,190,106 | B2 | 3/2007 | Downs et al. | |
| 7,305,954 | B2 | 12/2007 | Hagiwara et al. | |
| 7,328,677 | B2 | 2/2008 | Hagiwara et al. | |
| 7,808,166 | B2 | 10/2010 | Takeuchi et al. | |
| 7,827,954 | B2 | 11/2010 | Nagasawa et al. | |
| 7,959,482 | B2 | 6/2011 | Nakamura et al. | |
| 8,047,172 | B2 | 11/2011 | Nakamura et al. | |
| 8,082,897 | B2 | 12/2011 | Kato et al. | |
| 8,257,127 | B2 | 9/2012 | Nakamura et al. | |
| 2002/0063504 | A1 | 5/2002 | Hori | |
| 2006/0082276 | A1 | 4/2006 | Havard et al. | |
| 2009/0227168 | A1 | 9/2009 | Nakamura et al. | |
| 2012/0176020 | A1 | 7/2012 | Quitmeyer | |
| 2012/0184171 | A1 | 7/2012 | Nakamura et al. | |
| 2013/0320835 | A1 * | 12/2013 | Kowalski et al. | 313/141 |

* cited by examiner

*Primary Examiner* — Vip Patel

(74) *Attorney, Agent, or Firm* — Reising Ethington P.C.

(57) ABSTRACT

A spark plug has a metal shell, an insulator, a center electrode, and a ground electrode. One or more firing tips can be attached to the center electrode, to the ground electrode, or to both electrodes. The metal shell and ground electrode are attached together by way of one or more laser keyhole welds at an interface of the shell and electrode. Before the laser keyhole welds, resistance welding can be executed for a temporary attachment.

20 Claims, 3 Drawing Sheets

SPARK PLUG WITH LASER KEYHOLE WELD ATTACHING GROUND ELECTRODE TO SHELL

REFERENCE TO RELATED APPLICATIONS

This application claims the benefit of U.S. Provisional Ser. No. 61/780,096 filed on Mar. 13, 2013, the entire contents of which are incorporated herein.

TECHNICAL FIELD

This disclosure generally relates to spark plugs and, more particularly, to welding ground electrodes and metal shells together.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that causes the power stroke of the engine. The high temperatures, high electrical voltages, rapid repetition of combustion reactions, and the presence of corrosive materials in the combustion gases can create a harsh environment in which the spark plug functions.

Spark plugs typically include one or more ground electrodes and a metal shell supporting other components of the spark plug. The ground electrodes have traditionally been attached to the metal shells via a resistance welding process. While resistance welding has worked, sometimes welded material gets extruded laterally as the ground electrodes and shells are melted and pressed together. The extruded material might then require removal in a downstream metalworking process—this is sometimes referred to as weld flash removal. This may be especially true when certain nickel-based alloys are involved like those that go by the name Inconel® 601.

SUMMARY

According to one embodiment, a spark plug includes a metal shell with an axial bore, an insulator with an axial bore, a center electrode, and a ground electrode. The insulator is disposed partially or more within the metal shell's axial bore, and the center electrode is disposed partially or more within the insulator's axial bore. The ground electrode is attached to the metal shell by way of a fused weld joint at an interface between the ground electrode and the metal shell. The fused weld joint includes one or more laser keyhole weld(s). The laser keyhole weld(s) have material of the metal shell and material of the ground electrode solidified in a temporary cavity created via impingement of a laser beam producing the laser keyhole weld(s).

According to another embodiment, a spark plug includes a metal shell with an axial bore, an insulator with an axial bore, a center electrode, and a ground electrode. The insulator is disposed partially or more within the metal shell's axial bore, and the center electrode is disposed partially or more within the insulator's axial bore. The ground electrode is attached to the metal shell by way of a fused weld joint at an interface between the ground electrode and the metal shell. The fused weld joint includes multiple individual laser weld segments, and each individual laser weld segment extends across the interface between the ground electrode and the metal shell at a different location along the interface.

According to yet another embodiment, a method of assembling a spark plug includes several steps. One step involves providing a metal shell, an insulator, a center electrode, and a ground electrode. Another step involves aligning the ground electrode with a free end of the metal shell. And another step involves positionally securing the ground electrode and metal shell together at the free end of the metal shell. Yet another step involves creating one or more laser keyholes weld(s) at an interface between the ground electrode and metal shell. The laser keyhole weld(s) include solidified material of the ground electrode, and solidified material of the metal shell.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The spark plug described herein includes a fused weld joint with a laser keyhole weld that attaches a ground electrode to a metal shell. According to an exemplary embodiment, the laser keyhole weld is formed by a high energy density laser, such as a fiber laser, and results in a fused weld joint at the metal shell and ground electrode interface that may exhibit a number of desirable qualities. The laser keyhole weld may be used as a substitute for, or in addition to, standard ground electrode attachment techniques and processes. The laser keyhole weld can improve the attachment strength of the ground electrode, as well as the thermal and electrical conductivity across the metal shell and ground electrode interface. This may be different, for example, than certain solid state weld joints where the welded materials are primarily molecularly bonded without necessarily heating them above their respective melting temperatures and fusing them together. Because of the precision of a high energy density laser, there may not be a need for weld flash removal after the laser keyhole weld is formed.

Figure 1:
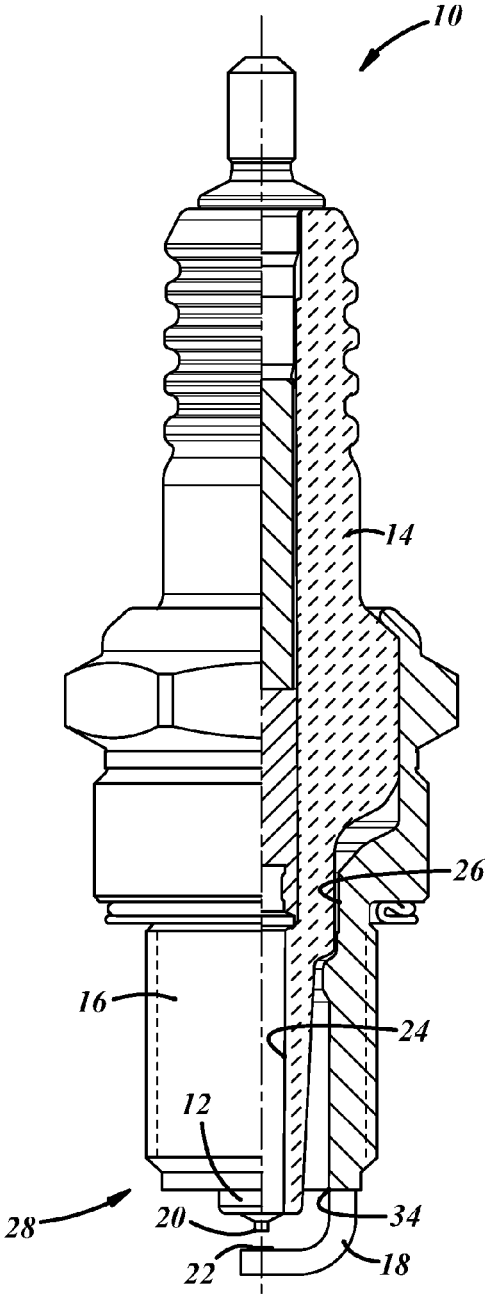
FIG. 1 is a partial cross-sectional view showing an exemplary spark plug.

An exemplary spark plug is illustrated in FIG. 1, where a fused weld joint with a laser keyhole weld is used to join or attach a ground electrode to a spark plug shell. In this particular embodiment, the spark plug 10 includes a center electrode 12, an insulator 14, a metal shell 16, and a ground wire or electrode 18. Other spark plug components can include a terminal stud, an internal resistor, various gaskets, internal seals, and precious metal firing tips, all of which are known to those skilled in the art. The center electrode 12 is an electrically conductive component and is generally disposed within an axial bore 24 of the insulator 14, and has an end portion that may be exposed outside of the insulator near a firing end of the spark plug 10. The insulator 14 is generally disposed within an axial bore 26 of the metal shell 16, and may have an end nose portion exposed outside of the shell near the firing end of the spark plug 10. The insulator 14 is preferably made of an insulating material, such as a ceramic composition, that electrically isolates the center electrode 12 from the metal shell 16. Firing tips 20, 22 may be respectively attached to the center and ground electrodes 12, 18 depending on the desired spark plug design, and may help form a spark gap where a spark initiates the combustion process during engine operation. Firing tips 20 and 22 are optional, however, as the spark gap could be defined by sparking surfaces from the center electrode 12, the ground electrode 18, or both.

The center electrode 12 and/or the ground electrode 18 may include a nickel-based external cladding layer and a copper-based internal heat conducting core. Some non-limiting examples of nickel-based materials that may be used with the center electrode 12 and/or the ground electrode 18 include alloys composed of nickel (Ni), chromium (Cr), iron (Fe), aluminum (Al), manganese (Mn), silicon (Si), and any suitable alloy or combination thereof such as the Ni-based alloys commonly referred to as Inconel® 600 and 601. The internal heat conducting core may be made of pure copper (Cu), Cu-based alloys, or some other material with suitable thermal conductivity. According to a non-limiting example, the ground electrode 18 includes a Ni-based external cladding layer and a Cu-based internal heat conducting core, where the external cladding layer is made from a Ni-based alloy having more than about 55 wt % Ni and more than about 20 wt % Cr. This type of high-chromium, nickel-based electrode material exhibits good strength, as well as desirable corrosion and erosion characteristics. Of course, other materials are certainly possible, including center and/or ground electrodes that have more than one internal heat conducting core or no internal heat conducting core at all.

The metal shell 16 provides an outer structure for the spark plug 10, and may have threads for installation in, and electrical communication with, an associated engine. The metal shell 16 may be made from a steel alloy or any other suitable material, and it may also be coated with a zinc-based or nickel-based alloy coating, for example. The ground electrode 18 is attached to a free end 28 of the metal shell 16 at an interfacial boundary or interface 34 between the ground electrode 18 and the metal shell 16, and as a finished product, may have one of a number of different configurations, including the common J-gap configuration shown in FIG. 1. The interface 34 is a surface-to-surface interface between the ground electrode 18 and the metal shell 16.

Figure 2:
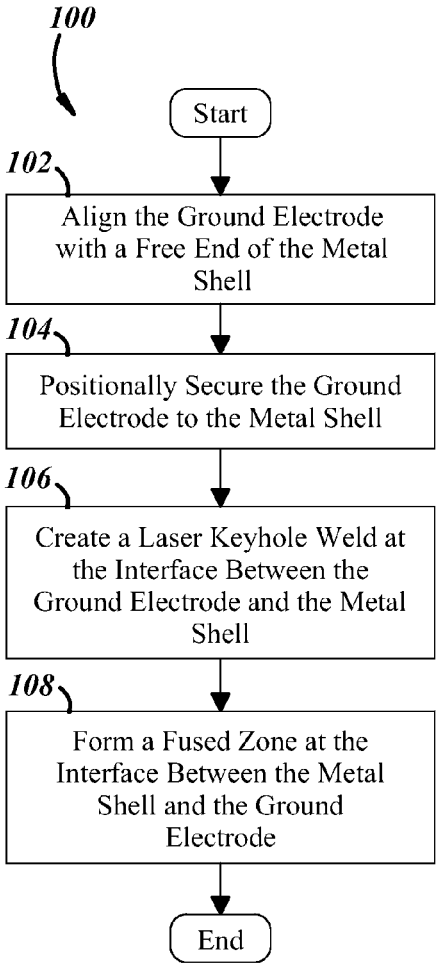
FIG. 2 is a flowchart diagramming different steps or stages of an exemplary method for attaching a ground electrode to a metal shell with a laser keyhole weld, and may be used with the spark plug of FIG. 1.
Figure 3:
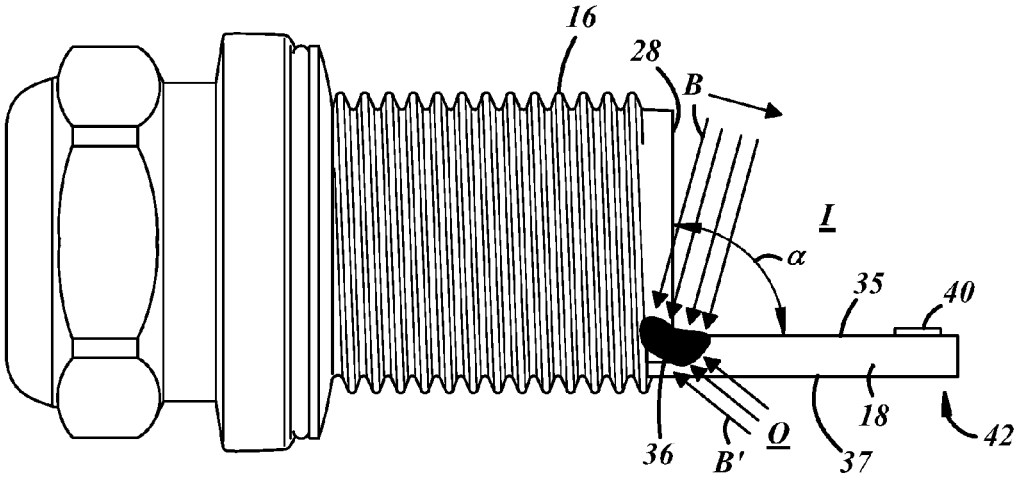
FIG. 3 is a side view showing an exemplary metal shell assembly having a ground electrode attached to the metal shell with a laser keyhole weld according to the method of FIG. 2.

An exemplary ground electrode attachment process 100 is represented diagrammatically in FIG. 2 and pictorially in FIG. 3. Beginning with step 102, the ground electrode 18 is aligned with the free end 28 of the metal shell 16. As shown in FIG. 3, the ground electrode 18 may be aligned orthogonally with the free end 28 of the metal shell 16 so that an angle $\alpha$ of about 90° is formed. This alignment may be done manually, or may be the result of a more precise automated process that uses a camera-based positioning device or the like to provide feedback to the system. Step 102 may also involve aligning the ground electrode 18 radially with respect to the free end 28 (radially here refers to the generally cylindrical shape of the spark plug 10).

The ground electrode 18 is then positionally secured on the free end 28 of the metal shell 16, as described in step 104 in FIG. 2. This may be done via a preliminary resistance weld, projection weld, or tack weld of the ground electrode 18 to the free end 28 of the metal shell 16. In the case of a projection weld, a projection or other protruding weld element may be used on the ground electrode 18, the metal shell 16, or both, but for purposes of manufacturing feasibility the projection is preferably part of the metal shell. Such a weld may create an initial weld joint that can be subsequently welded through or reinforced with an additional fused weld joint, as will be explained. It should be appreciated, however, that other securing methods may be used, such as a mechanical clamp or any other temporary holding technique that need not necessarily involve welding. Step 104 produces a temporary securement between the metal shell 16 and ground electrode 18. The temporary securement facilitates the permanent securement in subsequent steps. Furthermore, it should be understood that the alignment step 102 and the securing step 104 may be performed simultaneously by the same device.

In step 106, a concentrated and high energy density laser is used to create one or more laser keyhole welds at the interface 34 between the ground electrode 18 and the metal shell 16. A fiber laser can be used to perform this step, as well as other suitably concentrated and high energy density lasers that use Nd:YAG, $CO_2$, diode, disk, and hybrid laser equipment, with or without shielding gas (e.g., argon) in order to protect the molten weld pool. In the fiber laser example, the fiber laser emits a relatively concentrated and high energy density beam that creates a laser keyhole weld which, in turn, contributes to forming a fused weld joint between the different materials of the ground electrode 18 and the metal shell 16. The fiber laser can use a non-pulsed or continuous wave beam, a pulsed beam, or some other type. According to continuous wave example, the fiber laser operates at a power from about 150 W to 350 W and moves at a speed of about 10 mm/s to 20 mm/s relative to the workpiece; and according to a pulsed example, the fiber laser uses a square wave or bell-shaped pulse, has a pulse length from about 1.0 ms to 3.0 ms, operates at a frequency from about 200 Hz to 1,000 Hz, operates at a power from about 200 W to 400 W, and moves at a speed of about 10 mm/s to 20 mm/s relative to the workpiece. It should be appreciated, however, that the parameters listed above are merely exemplary and that such parameters could vary significantly based on factors such as the type and nature of the resistance weld used to initially attach the ground electrode to the shell and the laser optics, to cite a few possibilities.

Figure 4:
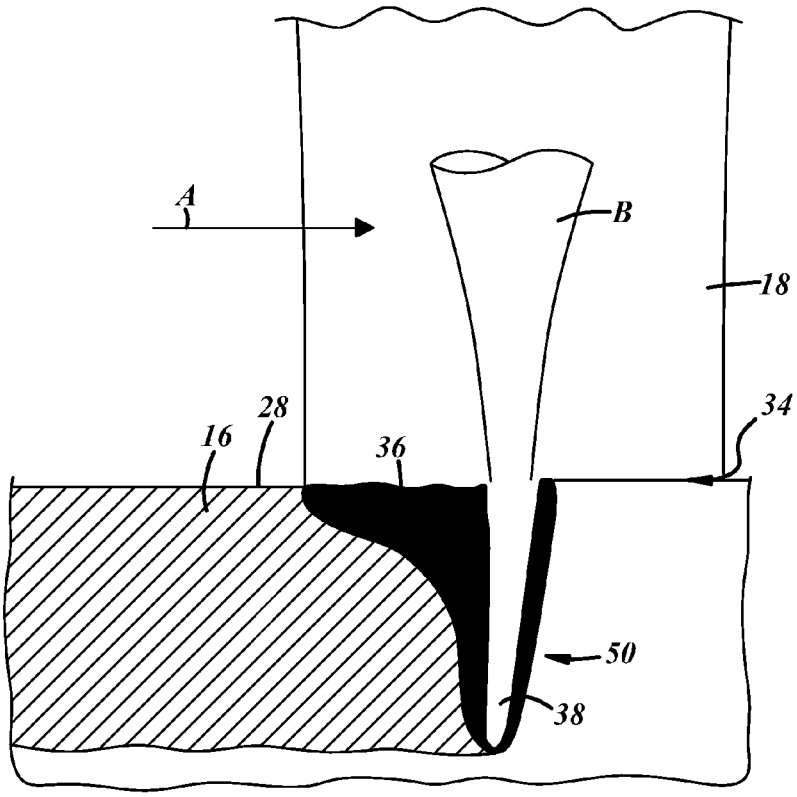
FIG. 4 is an enlarged view showing an exemplary laser keyhole weld formed according to the method of FIG. 2.

Referring now to FIGS. 3 and 4, the formation of the laser keyhole weld and the fused weld joint in step 106 is described in greater detail. With particular reference to the example illustrated in FIG. 3, a laser beam B from a high energy density laser may strike or impinge the interface 34 between the ground electrode 18 and the metal shell 16 on an inner side I of the ground electrode where it attaches to the shell and is separated by the angle $\alpha$, on the outer side O of the ground electrode, or both. Whether the laser beam B emanates from the inner side I or the outer side O can depend upon whether the laser beam B is also employed for executing other welds and the location of those other welds. For instance, if the laser beam B also executes a weld at a precious metal piece 40, then the laser beam B could take place at the inner side I for performing both in the same or nearly the same process. When executed at the inner side I, an exposed surface of the resulting weld is at a spark-gap facing surface 35 of the ground electrode 18. But if the laser beam B only executes the weld at the interface 34, then the laser beam B could take place at the outer side O. In some cases the outer side O may be preferred to the inner side I due to accessibility of the interface 34. When executed at the outer side O, an exposed surface of the resulting weld is at an outer surface 37 of the ground electrode 18.

Though the laser beam B is depicted in FIG. 3 by multiple arrows, the laser beam B can be a single beam that sweeps across the interface 34 as it moves to generate a particular weld pattern, as described below; in other words, the multiple arrows simply depict its movement. One potential reason for welding the interface 34 at the inner side I of the ground electrode 18 is the configuration of the interface from that perspective (i.e., a roughly 90° junction formed by angle $\alpha$) may lend itself well to the laser stitching patterns described below. As mentioned, another potential reason for using the laser beam B emanating from the inner side I of the ground electrode 18, as illustrated in FIG. 3, is because the same laser head (e.g., a galvo laser head having mirrors inside that move the laser beam B) may be subsequently used to attach the precious metal piece 40 to an inside surface of a ground electrode distal end 42. This utilization of the same laser to perform both functions can save time and money, as additional laser equipment can be eliminated. The laser beam B may strike the interface 34 at the same place where the initial weld joint was previously created in step 104; for example, laser beam B may penetrate into a previously created resistance weld.

In a different embodiment, the laser beam B' emanates from the outer side O of the ground electrode 18 and forms a fused weld joint at the interface 34 between the ground electrode 18 and the metal shell 16 from that perspective. Depending on the type and nature of the preliminary resistance weld that was used in step 104, step 106 may create a fused weld joint from both the inner and outer side I, O of the ground electrode 18. Such an approach could result in overlapping or touching keyhole welds from opposite sides of the ground electrode, as each of the high energy density lasers can form a keyhole weld that penetrates substantially into the thickness of the ground electrode 18 (e.g., each keyhole weld can penetrate 75% or more into the thickness of the ground electrode). The overlapping keyhole welds may be in the vicinity of a previously formed resistance or tack weld, and can strengthen the attachment of the ground electrode 18 to the metal shell 16. Indeed, in some cases the keyhole welds may penetrate almost entirely though the thickness of the ground electrode 18, where the resulting fused weld joint could be visible on the opposite side of laser beam emanation.

Referring now to FIG. 4, there is shown an exemplary process of forming a keyhole weld 50 at the interface 34 between the ground electrode 18 and the metal shell 16. The schematic illustration in FIG. 4 is from the perspective of the inner side I of the ground electrode 18 and is meant to show how a laser keyhole weld is created. The figure is depicted partly in sectional in order to show the laser keyhole weld in the midst of formation. As the laser beam B moves along the interface 34 (direction A) it melts, and in some cases vaporizes, the materials of the metal shell 16 and/or the ground electrode 18 in the area where it directly strikes or impinges them. This forms a temporary cavity 38 in the ground electrode 18 and/or the metal shell 16. The temporary cavity 38 is then quickly filled in by molten material from the immediately surrounding and adjacent area which is melted due to the thermal energy of the nearby laser beam B and flows into the cavity. This process of creating a temporary cavity 38 and then filling it in with melted material from the surrounding metal shell 16 and/or ground electrode 18 is completed until the keyhole weld 50 is finished and a fused weld joint 36 is formed. This process results in a small heat affected zone and weld nugget and forms a fused weld joint that includes material from both the ground electrode 18 and the metal shell 16 that has been melted and resolidified, as opposed to simply undergoing molecular bonding like in some conventional solid state laser welding processes. This process of using a high energy density laser like a fiber laser to form keyhole welds is particularly useful when used to attach a ground electrode made from a nickel-based material having a high chromium content (nickel-based alloy having more than about 55 wt % nickel (Ni) and more than about 20 wt % chromium (Cr)) to a metal shell, as such materials can sometimes be difficult to work with via other techniques. The keyhole weld 50 may extend radially (relative to the generally cylindrical shape of the spark plug 10) into the interface 34 and to a depth almost or entirely equal to the extent of surface-to-surface confrontation between the ground electrode 18 and metal shell 16 at the interface 34. In some instances, these radial depths have been found sufficient to ensure retention and weld strength between the ground electrode 18 and metal shell 16.

After completion of step 106, any number of additional post-attachment processes could be performed. Two examples of such processes are the process that attaches the precious metal firing tip 40 to the ground electrode 18 and the process of bending the ground electrode and aligning it with the center electrode 12 so that a properly sized spark gap is produced. Skilled artisans will know of other such post-attachment processes that may be used here as well.

Figure 5:
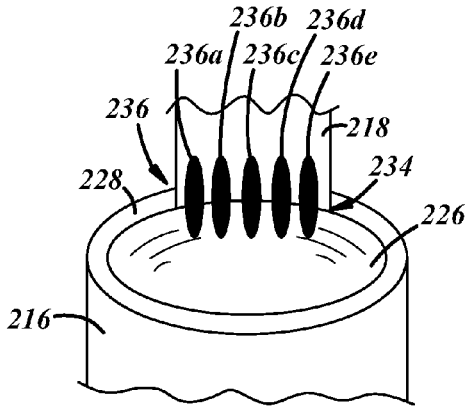
FIGS. 5-8 are perspective views showing different stitching patterns for a laser keyhole weld formed according to the method of FIG. 2.
Figure 6:
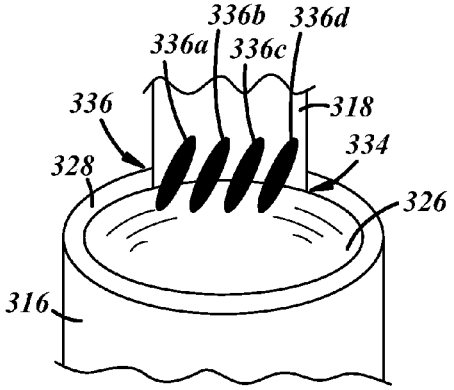
Figure 7:
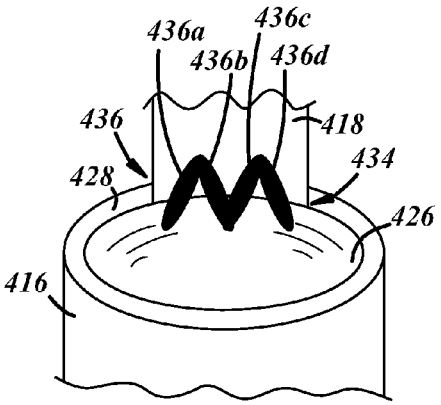
Figure 8:
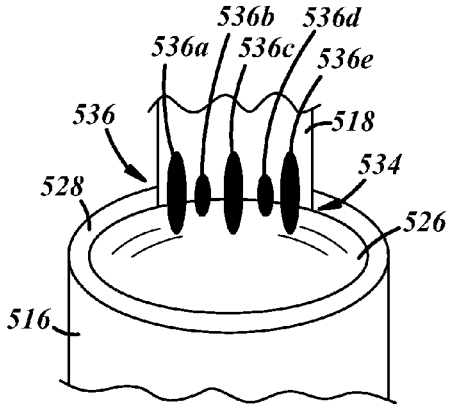

Turning now to FIGS. 5-8, there are shown several different examples of potential laser stitching patterns that may be used with a laser keyhole weld. The exact pattern employed may depend upon, among other factors, the thickness of the ground electrode, the thickness of the metal shell, the degree of heat generated as a result of laser welding, and the materials used for the ground electrode and metal shell. In FIG. 5, a keyhole weld pattern 236 spans or crosses over an interface 234 at a generally orthogonal angle relative to the interface and includes a number of individual weld segments 236*a-e* that are parallel to one another. Though depicted as separated from each other by spaces, one or more of the neighboring weld segments 236*a-e* could touch or overlap. FIG. 6 shows another embodiment in which the keyhole weld pattern 336 includes a number of individual weld segments 336*a-d* that extend across the interface 334 according to a non-orthogonal angle (i.e., the weld segments are angled or slanted with respect to the interface 334). Again, the individual weld segments 336*a-d* are generally parallel to one another. FIG. 7 is similar in this respect, but the laser keyhole weld pattern 436 has individual weld segments 436*a-d* that are not in an isolated stitch-style pattern as shown in FIGS. 5, 6, and 8. Rather, the weld segments 436*a-d* form a non-isolated or zigzag pattern (criss-crossing patterns could also be employed). The weld segments 436*a-d* overlap each other at their ends, as shown. This could be accomplished via one continuous weld with a single start and stop point, or with multiple and discrete welds having separate start and stop points. FIG. 8 shows that the individual weld segments 536*a-e* of laser keyhole weld 536 need not necessarily all be similar in size and/or shape with respect to one another. Moreover, variations in size, shape, number of segments, and pattern are certainly possible, depending on the particulars of the application in which it is used.

In the embodiments of FIGS. 5-8, having weld starting and weld stopping points located a distance away from the interface between the ground electrode and metal shell, and instead on the electrode or shell itself, may improve retention and weld strength at the interface. It has been found that initiation of a laser welding process such as the ones described herein (i.e., weld starting) and cessation of the laser welding process (i.e., weld stopping) may cause relatively forceful movement and stirring of the material struck by the laser beam at that point. And the movement and stirring may thereby form one or more cavities or craters below the immediately surrounding surface level, may form one or more protrusions jutting out above the surrounding surface level, may produce porosity at the welding starting/stopping point, or may result in a combination of these consequences. If formed to a great enough extent on the interface, these consequences may sometimes hinder retention and weld strength at the interface, though not always. Accordingly, initiating and ending the laser welding process away from the interface and instead on the ground electrode and/or metal shell may improve or ensure retention and weld strength. Nonetheless, it should be appreciated that weld patterns with weld starting and stopping points on the interface may still improve or ensure retention and weld strength.

Whatever laser stitching pattern utilized, it has been found that the fused weld joints described herein produce a joint with a strength greater than those sometimes produced in the previously-known resistance welds. In one testing procedure, a pulling force was applied to the fused weld joint described herein between the ground electrode and metal shell. The pulling force was increased and maintained until the ground electrode itself fractured at a site away from the fused weld joint, while the fused weld joint remained intact. This was an indication that the fused weld joint exhibited a greater strength than the ground electrode itself. When the same testing procedure was performed on a previously-known resistance weld joint, in contrast, the resistance weld joint fractured and the ground electrode remained intact. This was an indication that the resistance weld joint was weaker than the ground electrode. Of course, not all testing procedures will yield the same results.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a metal shell having an axial bore;

an insulator having an axial bore and being disposed at least partially within the axial bore of the metal shell;

a center electrode being disposed at least partially within the axial bore of the insulator; and a ground electrode attached to the metal shell via a fused weld joint at an interface between the ground electrode and the metal shell, the fused weld joint including at least one laser keyhole weld having material of the metal shell and material of the ground electrode solidified in a temporary cavity created via impingement of a laser beam producing the at least one laser keyhole weld.

2. A spark plug as set forth in claim 1, wherein the fused weld joint includes a resistance weld, and at least a portion of the at least one laser keyhole weld penetrates into at least a portion of the resistance weld.

3. A spark plug as set forth in claim 1, wherein the at least one laser keyhole weld is produced via a laser beam emitted generally at an inner side of the ground electrode and of the metal shell, and an exposed surface of the at least one keyhole weld is at a spark-gap facing surface of the ground electrode.

4. A spark plug as set forth in claim 3, wherein an unexposed portion of the at least one laser keyhole weld extends to a depth into a thickness of the ground electrode and substantially to an outer side of the ground electrode where the unexposed portion is visible at the outer side.

5. A spark plug as set forth in claim 1, wherein the at least one laser keyhole weld is produced via a laser beam emitted generally at an outer side of the ground electrode and of the metal shell, and an exposed surface of the at least one laser keyhole weld is at an outer surface of the ground electrode.

6. A spark plug as set forth in claim 1, wherein the fused weld joint includes a first laser keyhole weld formed on an inner side of the ground electrode and a second laser keyhole weld formed on an outer side of the ground electrode, and the first laser keyhole weld and the second laser keyhole weld penetrate into each other.

7. A spark plug as set forth in claim 1, wherein the fused weld joint includes a single laser keyhole weld extending continuously across the interface between the ground electrode and the metal shell.

8. A spark plug as set forth in claim 1, wherein the fused weld joint includes a plurality of individual laser keyhole weld segments that together form a continuous laser stitching pattern spanning across the interface between the ground electrode and the metal shell at a plurality of locations along the interface.

9. A spark plug as set forth in claim 1, wherein the fused weld joint includes a plurality of individual laser keyhole weld segments that form a discontinuous laser stitching pattern in which the individual laser keyhole weld segments are spaced apart from one another and span across the interface between the ground electrode and the metal shell at different locations along the interface.

10. A spark plug as set forth in claim 1, wherein the material of the ground electrode solidified in the temporary cavity is a nickel-based material with greater than approximately 20 wt % chromium (Cr).

11. A spark plug as set forth in claim 1, wherein the at least one laser keyhole weld has a weld starting point located on either the metal shell or the ground electrode and is distanced away from the interface and has a weld stopping point located on the other of the metal shell or the ground electrode and is distanced away from the interface, and the at least one laser keyhole weld extends from the weld starting point across the interface to the weld stopping point.

12. A spark plug, comprising:

a metal shell having an axial bore;

an insulator having an axial bore and being disposed at least partially within the axial bore of the metal shell;

a center electrode being disposed at least partially within the axial bore of the insulator; and a ground electrode attached to the metal shell via a fused weld joint at an interface between the ground electrode and the metal shell, the fused weld joint including a plurality of individual laser weld segments, each individual laser weld segment extending across the interface between the ground electrode and the metal shell at a different location along the interface.

13. A spark plug as set forth in claim 12, wherein each of the individual laser weld segments has a weld starting point and a weld stopping point, and neighboring individual laser weld segments overlap each other at the weld starting point of at least one of the neighboring individual laser weld segments, at the weld stopping point of at least one of the neighboring individual laser weld segments, or at the weld starting point of one of the neighboring individual laser weld segments and at the weld stopping point of the other of the neighboring individual laser weld segments.

14. A spark plug as set forth in claim 12, wherein the plurality of individual laser weld segments do not overlap one another at exposed surfaces of the plurality of individual laser weld segments.

15. A method of assembling a spark plug, the method comprising:

providing a metal shell and a ground electrode;

aligning the ground electrode with a free end of the metal shell;

positionally securing the ground electrode and metal shell together at the free end of the metal shell; and creating at least one laser keyhole weld at an interface between the positionally secured ground electrode and metal shell, the at least one laser keyhole weld including solidified material of both the ground electrode and the metal shell that, amid creation of the at least one laser keyhole weld, was driven into a temporary cavity created by vaporization via impingement of a laser beam.

16. A method as set forth in claim 15, further comprising creating the at least one laser keyhole weld to a depth penetrating into the ground electrode and into the metal shell at the interface that extends over at least a majority of the surface-to-surface confrontational extent of the interface.

17. A method as set forth in claim 15, wherein the step of positionally securing the ground electrode and metal shell comprises resistance welding the interface between the ground electrode and metal shell prior to creating the at least one laser keyhole weld.

18. A method as set forth in claim 15, wherein creating the at least one laser keyhole weld is performed at an inner side of the ground electrode and of the metal shell, at an outer side of the ground electrode and of the metal shell, or at both the inner side and the outer side.

19. A method as set forth in claim 15, wherein creating the at least one laser keyhole weld comprises creating a plurality of individual laser keyhole weld segments.

20. A method as set forth in claim 15, wherein creating the at least one laser keyhole weld comprises creating a weld starting point located on either the metal shell or the ground electrode at a location distanced away from the interface, creating a weld stopping point located on the other of the metal shell or the ground electrode at a location distanced away from the interface, or creating both the weld starting point and weld stopping point on the metal shell distanced away from the interface or located on the ground electrode distanced away from the interface.

* * * * *